US007520840B2

(12) United States Patent
Shifferaw

(10) Patent No.: US 7,520,840 B2
(45) Date of Patent: Apr. 21, 2009

(54) PORTABLE STEP EXERCISER

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 434 days.

(21) Appl. No.: 11/074,962

(22) Filed: Mar. 7, 2005

(65) Prior Publication Data

US 2006/0199703 A1 Sep. 7, 2006

(51) Int. Cl.
*A63B 26/00* (2006.01)

(52) U.S. Cl. ..... 482/52; 482/146; 482/147

(58) Field of Classification Search ..... None
See application file for complete search history.

(56) References Cited

U.S. PATENT DOCUMENTS

| | | | | | |
|---|---|---|---|---|---|
| 3,035,671 | A | * | 5/1962 | Sicherman | 52/183 |
| 3,295,847 | A | * | 1/1967 | Matt, Sr. | 482/80 |
| 3,628,791 | A | * | 12/1971 | Garcia | 482/51 |
| 4,477,070 | A | * | 10/1984 | Appelbaum | 482/28 |
| 4,496,147 | A | | 1/1985 | DeCloux | |
| 4,676,501 | A | * | 6/1987 | Hoagland et al. | 482/51 |
| 4,799,475 | A | * | 1/1989 | Iams et al. | 601/23 |
| 5,176,596 | A | | 1/1993 | Ullman | |
| 5,230,674 | A | * | 7/1993 | Terauds | 482/52 |
| 5,232,420 | A | * | 8/1993 | Terauds | 482/53 |
| 5,277,675 | A | | 1/1994 | Shifferaw | |
| 5,316,528 | A | * | 5/1994 | Ziparo | 482/52 |
| 5,352,169 | A | | 10/1994 | Eschenbach | |
| 5,413,543 | A | * | 5/1995 | Drago | 482/49 |
| 5,470,292 | A | * | 11/1995 | Simon | 482/52 |
| 5,474,509 | A | * | 12/1995 | Hodgdon | 482/52 |
| 5,507,708 | A | * | 4/1996 | Ma | 482/52 |
| 5,518,476 | A | * | 5/1996 | McLeon | 482/79 |
| 5,533,948 | A | | 7/1996 | Wilkinson | |
| 5,575,742 | A | * | 11/1996 | Wu | 482/92 |
| 5,669,659 | A | * | 9/1997 | Dittmer | 297/129 |
| 5,697,870 | A | | 12/1997 | Osborn | |
| 5,921,899 | A | | 7/1999 | Rose | |
| 6,068,577 | A | * | 5/2000 | Lo | 482/52 |
| 6,132,338 | A | * | 10/2000 | Shifferaw | 482/30 |
| 6,585,274 | B2 | * | 7/2003 | Sawyer | 280/37 |
| 6,976,939 | B2 | * | 12/2005 | Harker et al. | 482/52 |
| D520,083 | S | * | 5/2006 | Lu | D21/685 |
| 7,169,098 | B1 | * | 1/2007 | McGanty | 482/146 |
| D561,849 | S | * | 2/2008 | Piaget et al. | D21/670 |
| 2003/0186786 | A1 | * | 10/2003 | Hsu | 482/52 |
| 2007/0027009 | A1 | * | 2/2007 | Arnold | 482/146 |

* cited by examiner

*Primary Examiner*—Lori Amerson
(74) *Attorney, Agent, or Firm*—Edward S. Wright

(57) ABSTRACT

Portable machine for doing stair climbing exercises which has a base movable between horizontal and upright positions, a wheel mounted on the base for rolling engagement with the floor when the base is in the upright position, a first step movable between an operative position beside the base and a storage position within the base, a second step surmounted on the base, and a post pivotally attached to the base for movement between a supporting position generally perpendicular to the base and a handle position generally parallel to the base.

24 Claims, 5 Drawing Sheets

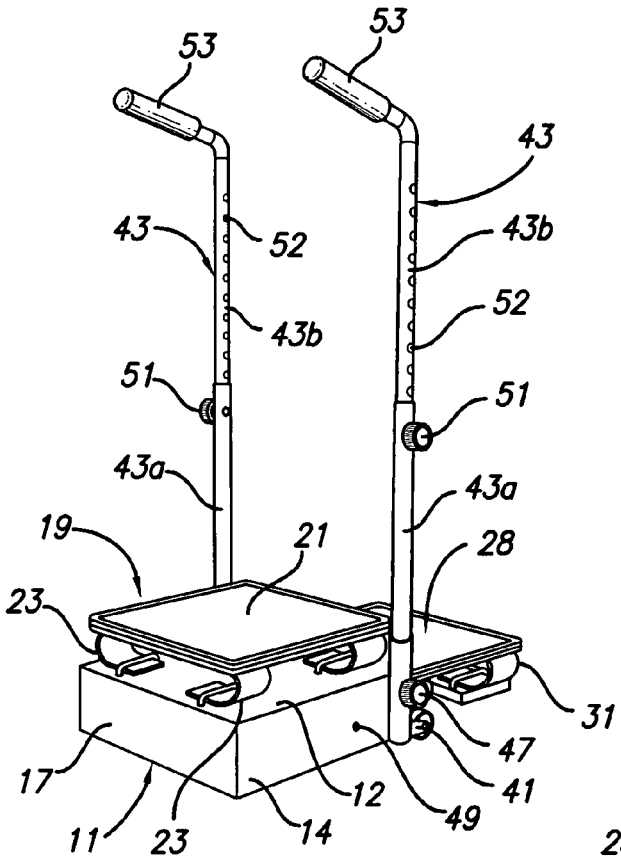
FIG. 1
FIG. 4
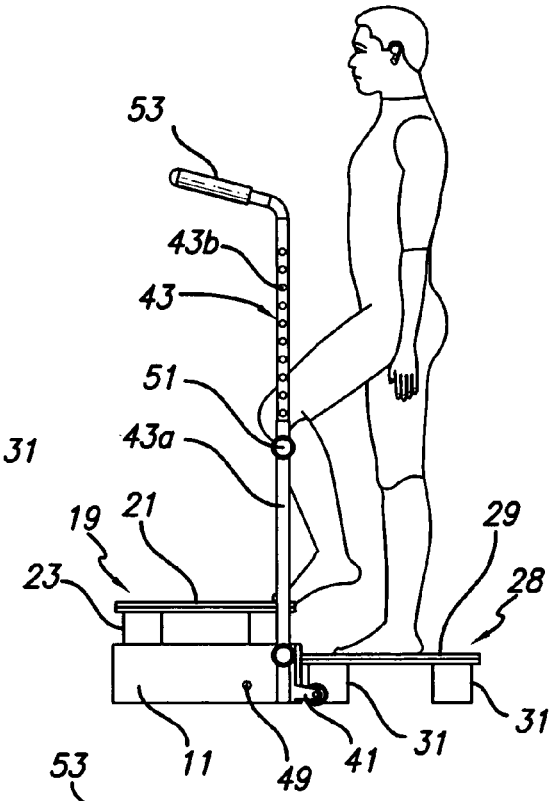
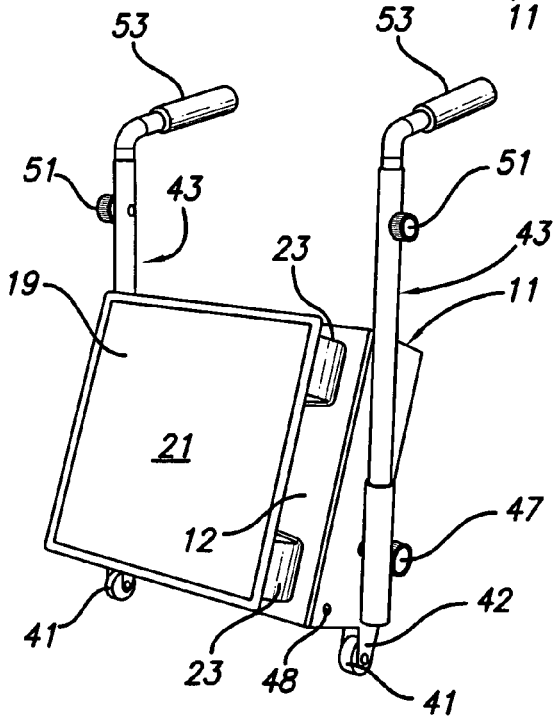
FIG. 5

PORTABLE STEP EXERCISER

BACKGROUND OF THE INVENTION

1. Field of Invention

This invention pertains generally to exercise equipment and, more particularly, to a portable machine for doing stepping or stair climbing exercises.

2. Related Art

In recent years, stepping machines have been a popular way of exercising the lower body or legs and, at the same time, getting a cardiovascular workout. A number of different types of such machines have been provided, including relatively large upright machines having pedals mounted on arms connected to hydraulic cylinders or other resistance elements, with handrails to the sides and in front of the exerciser. In addition to being bulky and difficult to move about, such machines are complex and expensive.

Another type of stepper machine heretofore provided has a pair of pedal arms mounted on a base or frame which rests on the floor. Examples of such machines are found in U.S. Pat. Nos. 5,232,420 and 5,230,674, the latter of which also folds up and serves as a baggage carrier. Such machines are more compact than the upright machines, but they are difficult to use since there are no handrails or other means to stabilize a person exercising on them.

U.S. Pat. Nos. 5,277,675 and 6,132,338 disclose resilient exercise boards which can be used for doing stepping exercises and a variety of other aerobic exercises. Those boards are light in weight, relatively inexpensive, and readily carried about. Other examples of portable step exercisers are found in U.S. Pat. Nos. 5,176,596 and 5,697,870.

OBJECTS AND SUMMARY OF THE INVENTION

It is in general an object of the invention to provide a new and improved machine for doing stepping or stair climbing exercises.

Another object of the invention is to provide a machine of the above character which is highly portable and overcomes the limitations and disadvantages of stepping machines heretofore provided.

These and other objects are achieved in accordance with the invention by providing a portable machine for doing stair climbing exercises which has a base movable between horizontal and upright positions, a wheel mounted on the base for rolling engagement with the floor when the base is in the upright position, a first step movable between an operative position beside the base and a storage position within the base, a second step surmounted on the base, and a post pivotally attached to the base for movement between a supporting position generally perpendicular to the base and a handle position generally parallel to the base.

BRIEF DESCRIPTION OF THE DRAWINGS

FIG. 1 is an isometric view of one embodiment of a portable machine for doing stepping or stair climbing exercises in accordance with the invention.

FIG. 4 is a side elevational view of the embodiment of FIG. 1 with a person exercising on the machine.

FIG. 5 is an isometric view of the embodiment of FIG. 1 with the machine in its folded state for movement and storage.

DETAILED DESCRIPTION

Figure 2:
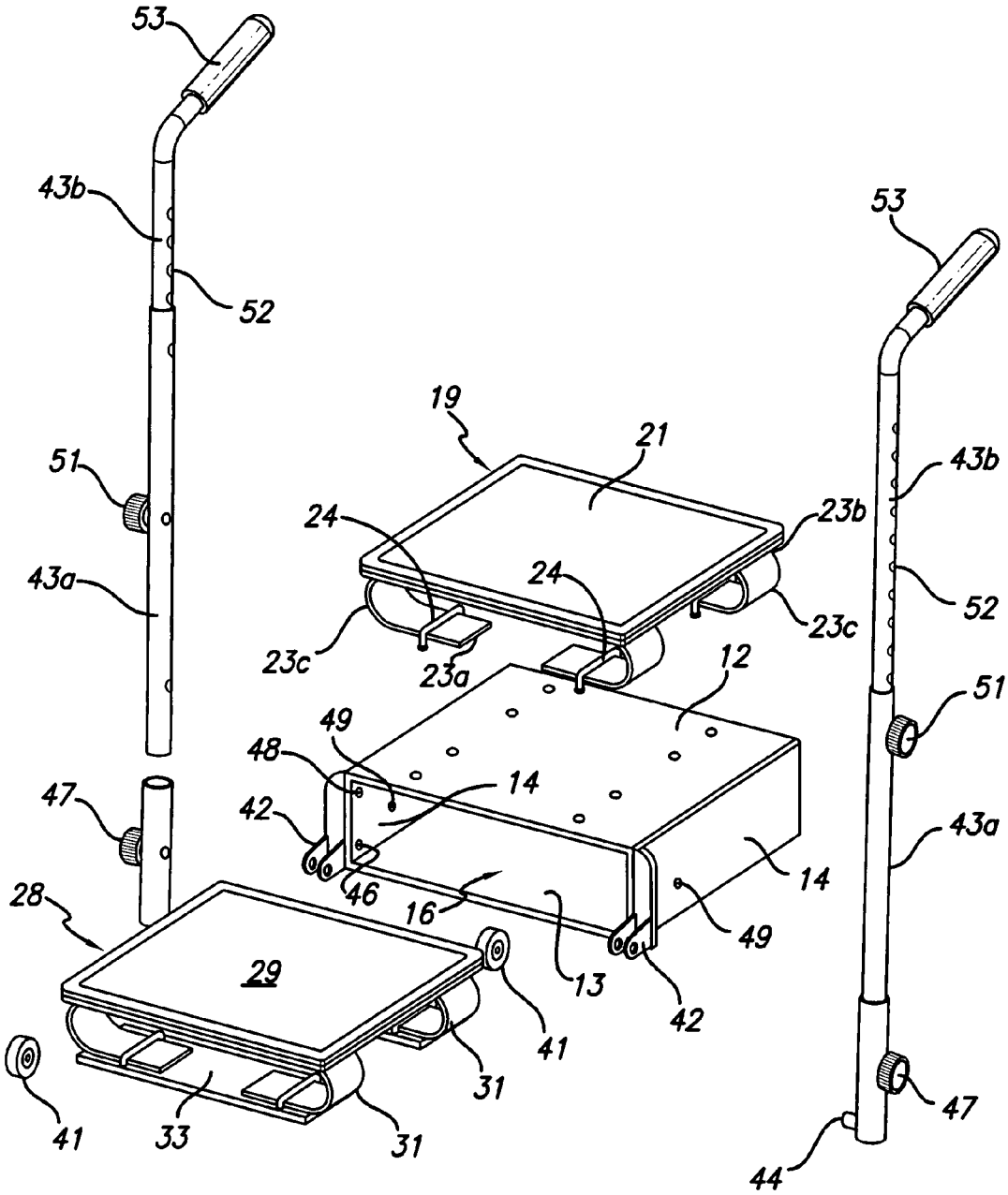
FIG. 2 is an exploded isometric view of the embodiment of FIG. 1.
Figure 3:
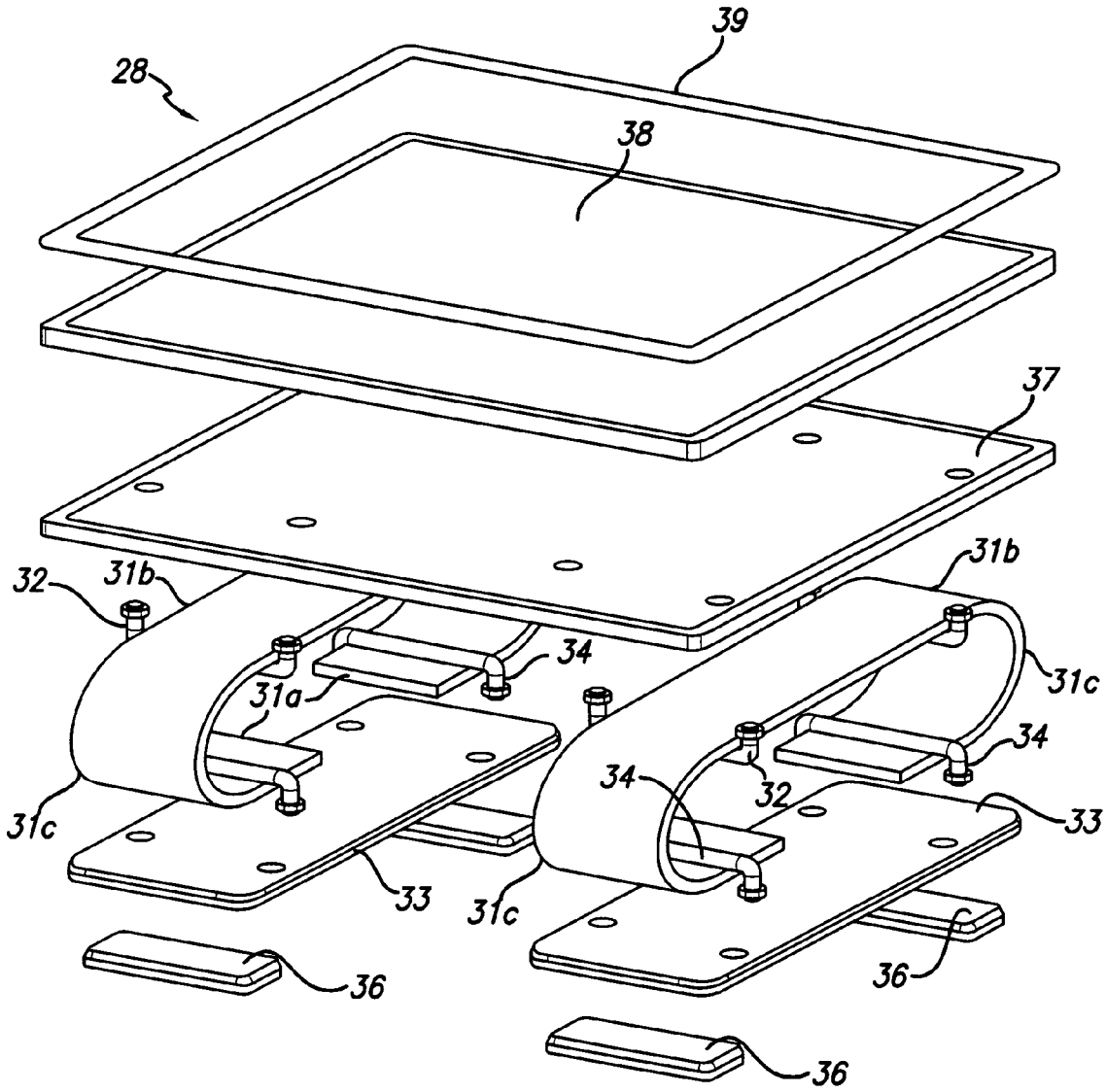
FIG. 3 is an exploded isometric view of one of the steps in the embodiment of FIG. 1.

In the embodiment of FIG. 1, the machine has a generally rectangular base 11 which is adapted to rest on the floor or other horizontal supporting surface in a generally horizontal position. The base has top and bottom panels 12, 13 and side panels 14, 14, a front opening 16, and a rear panel 17.

An upper step 19 is surmounted on the base. This step consists of a platform 21 and a plurality of springs 23 between the platform and the base. In this particular embodiment, the springs are C-shaped leaf springs having lower legs 23*a* attached to the top panel of the base by U-bolts 24, upper legs 23*b* attached to the under side of the platform by U-bolts (not shown), and outwardly curved portions or bights 23*c* between the legs. The springs are fabricated of a resilient material such as spring steel or carbon fiber. In the embodiment illustrated, the springs extend along the front and rear edges of the platform, but they can just as well extend along the side edges, and one or more additional springs can be utilized between them, if desired.

A lower step 28 is positioned in front of the base and adapted to be slid into the base through the opening 17 and secured there for movement and storage of the machine. This step also has a platform 29 with a plurality of springs 31 beneath it. Springs 31 are similar to springs 23, and their upper legs 31*b* are attached to the under side of platform 29 by U-bolts 32. Mounting feet 33 are attached to the lower legs 31*a* of springs 31 by U-bolts 34, with skid resistant pads 36 on the under sides of the feet.

The two platforms are similar in construction, and each has a substantially rigid, yet flexible, substrate 37, a resilient pad 38 above the substrate, and a peripheral rim or frame 39.

A pair of wheels are 41 mounted on the front side of base 11 for use in moving the machine about. The wheels are rotatably mounted in forks 42 which extend in a forward direction from the base for engagement with the floor when the rear portion of the base is raised.

A pair of uprights or posts 43 are disposed on opposite sides of the base for use as supports for a person exercising on the steps and as handles by a person moving the machine about on its wheels. The posts are pivotally attached to the base by axles or pins 44 which are received in openings 46 in side panels 14, with thumbscrews 47 selectively engagable with nuts 48, 49 in the side panels for holding the posts in the supportive and handle positions. In the supportive position, the posts are generally perpendicular to the base, and in the handle position, they are generally parallel to it.

The posts are axially extensible with telescoping sections 43*a*, 43*b* with thumbscrews 51 engagable with aligned openings 52 in the two sections for holding them in a desired position. Hand grips 53 extend rearwardly at an angle on the order of 135 degrees from the upper ends of the posts.

Operation and use of the machine is as follows. Base 11 is placed in a horizontal position on the floor or other supporting surface with lower step 28 in front of it and posts 43 extending vertically. The length of the posts is adjusted so that a person exercising on the machine can grasp hand grips 53 for stability and support.

To move the machine about, the lower step is slid into the base and secured, and the posts are retracted and moved to the handle position, i.e. generally parallel to the base, as shown in FIG. 5. A person can then lift the base to an upright or inclined position, using the posts as handles to pivot the base onto the wheels, then roll the machine about, using the posts as a handle to guide it.

Figure 6:
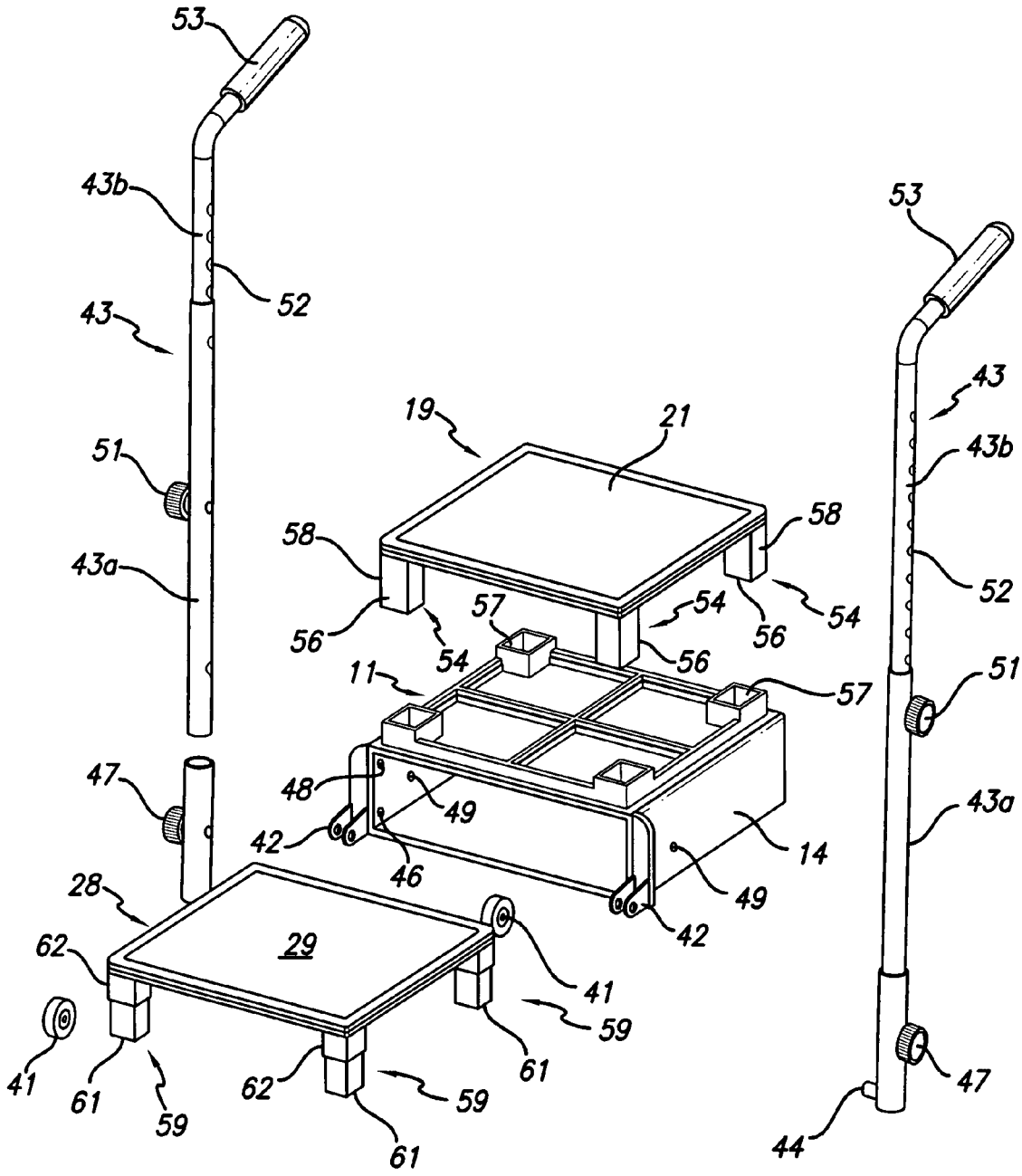
FIG. 6 is an exploded isometric view of another embodiment of a portable machine for doing stepping or stair climbing exercises in accordance with the invention.

The embodiment illustrated in FIG. 6 is generally similar to the embodiment of FIG. 1, and like reference numerals designate corresponding elements in the two embodiments. In the embodiment of FIG. 6, however, the platforms which form the steps are supported by resilient legs instead of springs. Upper step 19 is thus mounted on base 11 by legs 54 near the corners of the platform. Each of the legs has a block of resilient material 56 such as ethyl vinyl acetate or polyurethane which is received in vertically aligned pockets 57, 58 on the upper side of the base and the lower side of the platform.

Step 28 likewise has legs 59 near its corners of its platform. Those legs have blocks of resilient material 61 which rest upon the floor and are received in pockets formed by flanges 62 on the lower side of the platform. The blocks of resilient material for both steps are affixed in the pockets by an adhesive.

Operation and use of the embodiment of FIG. 6 is similar to that of the embodiment of FIG. 1.

Figure 7:
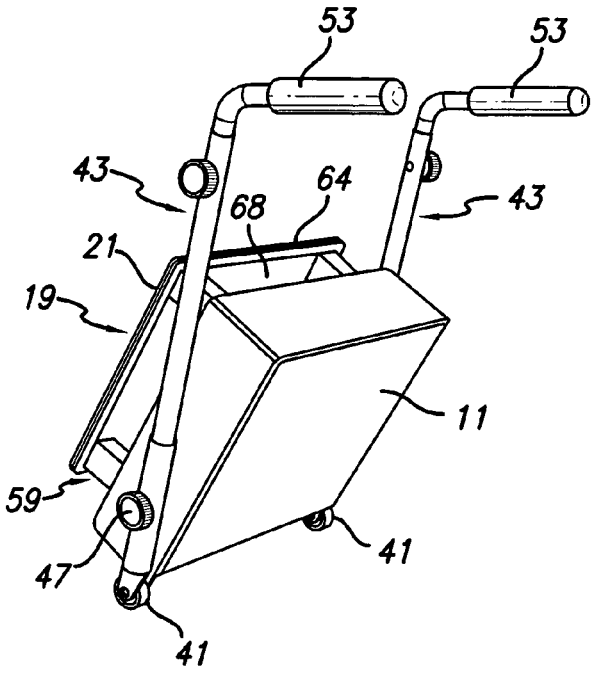
FIG. 7 is an isometric view of another embodiment of a portable machine for doing stepping or stair climbing exercises in accordance with the invention.
Figure 8:
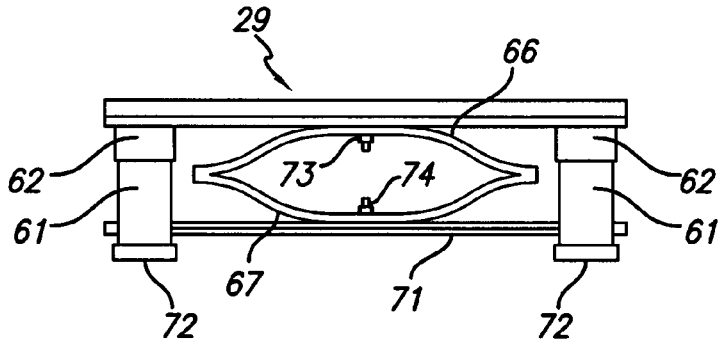
FIG. 8 is a front elevational view of one of the steps in the embodiment of FIG. 7.
Figure 9:
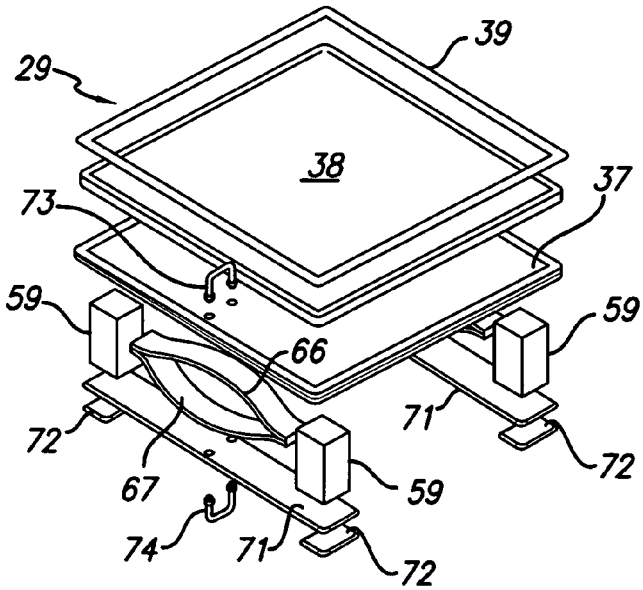
FIG. 9 is an exploded isometric view of one of the steps in the embodiment of FIG. 7.

The embodiment of FIG. 7 is similar to the embodiment of FIG. 6, with the addition of leaf springs 64 which supplement the resilient legs 59 in supporting the step platforms. Each of the springs has two arched leaves 66, 67 which are disposed back-to-back, with the arches facing away from each other, and connected together at their ends. The leaves can be fabricated of any suitable material such as spring steel or fiberglass, and in the embodiment shown, they extend along the front and rear edges of the platforms.

The upper leaves 66 of the springs for upper step 19 are attached to the lower side of platform 21 by U-bolts 68, and lower leaves 67 are similarly attached to the top panel 12 of base 11 by U-bolts (not shown) so that the springs provide additional resiliency and resistance to downward movement of the step.

In lower step 28, the arched leaf springs are positioned between the underside of platform 29 and the upper sides of mounting feet 71 which extend along the front and rear edges of the step beneath resilient legs 59. Mounting feet 71 are similar to the mounting feet 33 in the embodiment of FIG. 1, and have skid resistant pads 72 on their under sides. The upper leaves 66 of springs 64 are attached to the under side of platform 29 by U-bolts 73, and the lower leaves 67 attached to the upper sides of mounting feet 71 by U-bolts 74.

Operation and use of the embodiment of FIG. 7 is similar to that of the other embodiments, with arched leaf springs 64 supplementing resilient legs 59 to provide additional resiliency and resistance to downward movement of the steps.

The invention has a number of important features and advantages. It provides a highly portable step exerciser with two resilient steps which can be set up quickly and easily and then folded up and rolled about when not in use.

It is apparent from the foregoing that a new and improved machine for doing stepping or stair climbing exercises has been provided. While only certain presently preferred embodiments have been described, as will be apparent to those familiar with the art, certain changes and modifications can be made without departing from the scope of the invention as defined by the following claims.

The invention claimed is:

1. A portable machine for doing stair climbing exercises, comprising: a base movable between horizontal and upright positions, a wheel mounted on the base for rolling engagement with the floor when the base is in the upright position, a first step movable between an operative position beside the base and a storage position within the base, a second step surmounted on the base, and a post pivotally attached to the base for movement between a supporting position generally perpendicular to the base and a handle position generally parallel to the base.

2. The machine of claim 1 wherein each of the steps comprises a platform and a plurality of resilient supports beneath the platform.

3. The machine of claim 2 wherein the resilient supports include springs.

4. The machine of claim 2 wherein the resilient supports are C-shaped leaf springs.

5. The machine of claim 2 wherein the resilient supports include blocks of resilient material.

6. The machine of claim 2 wherein the resilient supports include arched leaf springs.

7. The machine of claim 2 wherein the platforms are flexible.

8. The machine of claim 1 wherein the post is axially extensible.

9. The machine of claim 1 including a grip at the upper end of the post which can be grasped for support by a person exercising on the steps and in a guiding manner by a person who is rolling the machine about.

10. A portable machine for doing stair climbing exercises, comprising: a base having an open front adapted to rest on a supporting surface, a first step comprising a platform with resilient supports movable between an operative position in front of the base and a storage position within the base, a second step comprising a platform with resilient supports surmounted on the base, a pair of wheels mounted in front of the base for rolling engagement with the supporting surface when the rear of base is raised, a pair of posts pivotally mounted to opposite sides of the base, means for selectively securing the posts in a first position generally perpendicular to the base and a second position generally parallel to the base, and grips at the upper ends of the posts which serve as handrails for a person exercising on the steps when the posts are in their first position and as handles a person rolling the machine about when the posts are in their second position.

11. The machine of claim 10 wherein the resilient supports include springs.

12. The machine of claim 10 wherein the resilient supports include C-shaped leaf springs.

13. The machine of claim 10 wherein the resilient supports include blocks of resilient material.

14. The machine of claim 10 wherein the resilient supports include blocks of resilient material near the corners of the platform and arched leaf springs between the blocks of resilient material along opposite edges of the platform.

15. The machine of claim 10 wherein the platforms are flexible.

16. The machine of claim 10 wherein the posts are axially extensible and retractable.

17. A portable machine for doing stair climbing exercises, comprising: a base having an open front, a plurality of springs mounted on the base, a platform mounted on the springs to form an upper step, a platform mounted on springs in front of the base to form a lower step which can be slid into the base when not in use, wheels mounted in front of the base for rolling engagement with the floor when the rear of base is raised, and means connected to the base for use as a support by a person exercising on the steps and as a handle by a person rolling the machine around on the wheels.

18. The machine of claim 17 wherein the springs are C-shaped leaf springs.

19. The machine of claim 17 wherein the springs are arched leaf springs.

20. The machine of claim 17 wherein the platforms are flexible.

21. A portable machine for doing stair climbing exercises, comprising: a base having an open front, a plurality of resilient legs mounted on the base, a platform mounted on the legs to form an upper step, a platform mounted on legs in front of the base to form a lower step which can be slid into the base when not in use, wheels mounted in front of the base for rolling engagement with the floor when the rear of base is raised, and means connected to the base for use as a support by a person exercising on the steps and as a handle by a person rolling the machine around on the wheels.

22. The machine of claim 21 wherein the resilient legs include blocks of resilient material.

23. The machine of claim 21 wherein the platforms are flexible.

24. The machine of claim 21 further including arched leaf springs between the legs on opposite sides of the platforms.

* * * * *